US006332279B1

(12) United States Patent
Fukuhori et al.

(10) Patent No.: US 6,332,279 B1
(45) Date of Patent: Dec. 25, 2001

(54) DRYING DEVICE

(75) Inventors: Shinji Fukuhori; Hidetomo Ito, both of Kanagawa (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/717,352

(22) Filed: Nov. 22, 2000

(30) Foreign Application Priority Data

Nov. 22, 1999 (JP) ..... 11-330904

(51) Int. Cl.[7] ..... F26B 58/00
(52) U.S. Cl. ..... 34/114; 34/446; 34/542
(58) Field of Search ..... 34/114, 115, 122, 34/168, 169, 443, 444, 446, 467, 471, 541, 542

(56) References Cited

U.S. PATENT DOCUMENTS 4,952,145 * 8/1990 Kwiatkowski et al. ..... 432/59
5,428,904 * 7/1995 Rutz ..... 34/219
5,946,819 * 9/1999 Reimer et al. ..... 34/541

FOREIGN PATENT DOCUMENTS 48-44151 12/1973 (JP) ..... F26B/13/20
51-22115 7/1976 (JP) ..... F26B/13/10
7-289971 11/1995 (JP) ..... B05C/9/14
9-152274 6/1997 (JP) ..... F26B/21/04

OTHER PUBLICATIONS

Patent Abstracts of Japan 0789971 Nov. 7, 1995.
Patent Abstracts of Japan 09152274 Jun. 10, 1997.

* cited by examiner

*Primary Examiner*—Teresa Walberg
*Assistant Examiner*—Thor Campbell
(74) *Attorney, Agent, or Firm*—Sughrue Mion, PLLC

(57) ABSTRACT

A drying device in which temperature and humidity of a gas flow fed into each of plural helical dryers in the form of a cylinder (i.e., temperature and humidity of an exhausted gas flow) can be each controlled independent of the other dryers. The drying device, is equipped with a casing. The casing includes therein at least a helical dryer 6 in the form of a cylinder for exhausting a drying gas flow fed therein out of gas distributed on its outer periphery to feed on a drying object, and an axial-flow blower 5 connected to an entrance side of the helical dryer for inspiring a gas flow exhausted out of the helical dryer into the casing inside the same casing and feeding into the helical dryer again to circulate said gas flow, in which a part of a gas flow inspired by the axial-flow blower serves as a gas flow having a depressed dew point which results from splitting a gas flow exhausted out of the helical dryer and depressing the dew point of the split gas flow in a dehumidifying facility 1 located outside the casing.

13 Claims, 5 Drawing Sheets

DRYING DEVICE

FIELD OF THE INVENTION

The present invention relates to a drying device, more particularly, to a device for drying the surface necessary to be dried by feeding a gas flow, especially by multi-steps, to an object necessary to be dried (a drying object), which has a surface desired to be dried, such as a long web-shaped drying object with a coating solution coated thereon and the like.

BACKGROUND

As a device for drying the surface necessary to be dried by feeding a drying gas flow to a long belt-shaped drying object having the surface necessary to be dried such as coating film and the like, for example, those disclosed in JP-B-48-44151/1973, JP-B-51-22115/1975, JP-A-7-289971/1995 and JP-A-9-152274/1997 (the term "JP-A" as used herein means a Kokai-Publication, i.e., "unexamined laid-open Japanese patent application" and the term "JP-B" as used herein means a Kokoku-Publication, i.e., "examined published Japanese patent application") are known.

In a conventional drying device, as disclosed in, for example, JP-A-7-289971/1995, a drying gas flow (blow) is sent from a blower through a duct (pipe line) to a temperature and relative humidity control unit for controlling temperature and humidity, and then, fed through another duct to a blowing unit (dryer) of the drying gas flow in a drying room.

A gas flow, which has been exhausted for drying by colliding with a coated surface (the surface necessary to be dried) of a drying object in a drying room, is used for feeding again into another drying room after being recovered through an exhaust vent of the drying room and then heated up to a desired temperature in a duct equipped with a heater for heating the gas flow up to any desired temperature. As disclosed in JP-A-9-152274/1997, in some case, the gas flow before feeding is admixed with a fresh gas if necessary and then reused.

An embodiment of a conventional drying device is shown in reference to FIG. 5 in the accompanying drawings. FIG. 5 is a schematic view showing a general composition of units contained in a conventional drying device.

A conventional drying device shown in FIG. 5 has a component unit (or assembly unit) P including ducts (D2, D3, D4) so as to let a gas flow come out of a blower 41*a,* pass through an inner space of temperature and relative humidity control unit 42*a,* helical dryer 43*a,* and drying room 44*a* consecutively in this order, and arrive at a blower 41*b.* This details will be explained as follows.

The blower 41*a* feeds a gas blow, after being dehumidified in a dehumidifying facility 40 and then passing through a duct D1, through the duct D2 into the temperature and relative humidity control unit 42*a.* The temperature and relative humidity control unit 42*a* can set the temperature and the humidity of the gas flow to a predetermined value which is appropriate for drying a drying object. The gas flow, after setting the temperature and the humidity to the predetermined value in the temperature and relative humidity control unit 42*a,* is fed through the duct D3 to an end of the helical dryer 43*a,* which has approximately a cylindrical shape, into an inner space of the helical dryer.

The helical dryer 43*a* is installed in the drying room 44*a* (the inner space of the dryer). In the outer periphery (wall) of the helical dryer 43*a* having a cylindrical shape, exhaust vents (e.g., holes or slits) are disposed, and a drying gas flow is exhausted out of the exhaust vents. A drying object is placed so as to bring its surface necessary to be dried into contact with a drying gas flow exhausted out of the exhaust vents of the helical dryer 43*a,* so that the surface of the drying object necessary to be dried is dried. The gas flow after drying the drying object will pass through the duct D4 and arrive at a blower 41*b* placed outside the drying room 44*a.*

The conventional drying device shown in FIG. 5 further has a component unit Q including ducts (D5, D6, D7) arranged so as to make a gas flow come out of a blower 41*b,* pass through temperature and relative humidity control unit 42*b,* helical dryer 43*b,* and drying room 44*b* in this order, and arrive at a blower 41*c.*

The conventional drying device shown in FIG. 5 also has a component unit R including ducts (D8, D9, D10) arranged so as to make a gas flow come out of a blower 41*c,* pass through temperature and relative humidity control unit 42*c,* helical dryer 43*c,* and drying room 44*c* in this order, and arrive at a blower 41*d.*

The conventional drying device shown in FIG. 5 still more has a component unit S including ducts (D11, D12, D13) arranged so as to make a gas flow come out of a blower 41*d,* pass through temperature and relative humidity control unit 42*d,* helical dryer 43*d,* and drying room 44*d* in this order, and arrive at a dehumidifying facility 40.

The blowers, the temperature and relative humidity control units, the helical dryers and the drying rooms found in the component units Q, R and S are same with the blower 41*a,* the temperature and relative humidity control unit 42*a,* the helical dryer 43*a* and the drying room 44*a* found in the component unit P, respectively, and the former units have the same functions as the latter ones, respectively.

A gas flow, returned through the duct D13 to the dehumidifying facility 40, is dehumidified, passed through the duct D1 and fed into the blower 41*a.* Then, the aforementioned procedure is repeated.

In case of drying a long web-shaped drying object having a surface necessary to be dried by using the conventional drying device shown in FIG. 5, each drying room has slits through which a drying object passes, rolls for guide and the like, so that the drying object can be passed through the drying rooms 44*a,* 44*b,* 44*c* and 44*d* successively. Further, the drying gas flow can be fed out of the helical dryers installed in the drying rooms, respectively. Consequently, the drying object can be dried.

SUMMARY OF THE DISCLOSURE

Though each of the helical dryers is equipped with a temperature and relative humidity control unit on the upstream side of a flowing gas flow, the aforementioned conventional drying device employs a system in which the dehumidified gas flow (blow) fed out of one dehumidifying facility is used sequentially in series in the plural number of the helical dryers. Accordingly, for instance, in case of drying a drying object having an aqueous coating using a dehumidified gas flow, the dew point of gas of the dehumidified gas flow gradually rises with water evaporated out of the drying object as it is used sequentially in the respective drying rooms. Consequently, it is difficult to control the dew point of a gas flow fed into each of the helical dryers (therefore, the dew point of an exhausted gas flow) independent of the other dryers.

Accordingly, an object according to an aspect of the present invention is to solve the problem in the prior art and to provide a drying device in which the temperature and humidity of a gas flow fed into each of plural (e.g., helical) dryers (therefore, the temperature and humidity of an exhausted gas flow) can be controlled respectively independent of the other dryers. Other aspects and objects will become apparent in the entire disclosure.

According to an aspect of the present invention, there is provided a novel drying device having a casing including therein at least a cylindrical drying cylinder which exhausts a drying gas flow fed in it out of gas-blowing area (of openings) disposed on its outer periphery to feed the gas on a drying object, and a fan connected to an entrance side of the drying cylinder. The fan intakes a gas flow blown out of the drying cylinder into the casing inside the casing and feeds the gas into the drying cylinder again to circulate the gas flow. A part of a gas flow intaken by the fan has a depressed dew point which results from splitting a gas flow blown out of the drying cylinder and depressing the dew point of the split gas flow outside the casing. The drying device of the present invention may be constituted as follows.

The drying device may include a plural number of the casings. Each of the casings may be connected to an exhaust duct and a feed duct. The exhaust duct exhausts outside a part of a gas flow blown out of the drying cylinder into the casing and fed on the drying object. The exhaust duct communicates with a dew point depression unit, and a feed duct for feeding a gas flow having a depressed dew point obtained by depressing the dew point of a gas flow exhausted out of the exhaust duct by the dew point depression unit.

The fan may be an axial-flow blower having an annular inlet for intaking a gas flow at an inlet side of the axial-flow blower. The drying device may have an influent control unit of a directly circulated gas flow, which is a gas flow flowing into the fan but not the gas flow having the depressed dew point, for controlling the amount of the directly circulated gas flow at an outer area (radially outer area) of the fan. The drying device may also have an influent control unit of a gas flow having a depressed dew point for controlling the amount of the gas flow flowing into the fan at the (radially) outer peripheral area of the fan.

According to another aspect of the present invention, there is provided another drying device equipped with an outer casing, which includes therein at least an inner casing which blows a drying gas flow fed in it out of openings disposed (and distributed) on its outer periphery to feed the gas on a drying object, a fan connected to an entrance side of the inner casing for intaking a gas flow blown out of the inner casing into the outer casing and feeding into the inner casing again to circulate said gas flow. There is a dew point depressing unit which splits a gas flow blown out of the inner casing into the outer casing to provide a split (partial) gas flow, depresses the dew point of the split gas flow, and feeds the resultant gas flow having the depressed dew point into the fan. This type of the drying device may be constituted as follows.

The drying device may have a plurality of the outer casings. Each of the outer casings may be connected to an exhaust duct, and a feed duct, respectively. The exhaust duct partially exhausts a gas flow blown out of the inner casing into the outer casing and fed on the drying object. Also the exhaust duct communicates with a dew point depression unit. The feed duct is configured for feeding a gas flow having a depressed dew point obtained by depressing the dew point of a gas flow exhausted out of the exhaust duct by the application of dew point depression unit. The fan may be an axial-flow blower having an annular inlet (or vent) for intaking a gas flow at an inlet side of the axial-flow blower.

There is an opening-less (or opening-free) area located between the nearest opening to the axial-flow blower of all openings disposed on the outer periphery of the inner casing and the inlet (vent) of the axial-flow blower. In the opening-less area, there are provided a flow-restricting plate (or buffle), which partitions (divides) the inside of the outer casing into two parts, leaving an annular space opened around the outer periphery of the inner casing and the axial-flow blower. Also there is a return vent which opens through the flow-restricting plate or opens on the openings side relative to the flow-restricting plate, where the openings are disposed (or distributed) on the outer periphery of the inner casing. The return vent communicates with the dew point depression unit.

The axial-flow blower may be in the form of a cylinder and include an annular inlet for intaking a gas flow in the (radially) outer area of the outer periphery of the axial-flow blower. The drying device may further include a partition board which divides the intake inlet (or vent) into two parts axially of the axial-flow blower and also the inside of the outer casing into two parts, to provide an influent room of a gas flow having a depressed dew point. The influent room communicates with one part of the divided inlet and has an inlet of a gas flow having depressed dew point, inside the outer casing. There is a return vent which opens through the partition board or opens on the openings side, relative to the partition plate, the openings being disposed on the outer periphery of the inner casing. The return vent communicates with the dew point depression unit.

In a further aspect of the present invention, the drying device many further comprise a first and second outer casings. The first outer casing includes therein at least a first inner casing for blowing a drying gas flow fed therein out of openings disposed (or distributed) on its outer periphery to feed the gas on a drying object. The second outer casing includes at least a second inner casing for blowing a drying gas flow fed therein out of openings disposed (distributed) on its outer periphery to feed the gas on a drying object, a fan connected to an inlet side of the second inner casing, and an influent room of a gas flow for letting the gas flow inspired by the fan flow therein. A gas flow fed on a drying object in the first outer casing subsequently flows into the influent room disposed in the second outer casing. The exit of the gas flow provided in the first outer casing may serve as an inlet of the gas flow provided in the influent room disposed in the second outer casing. Further, there may be provided at least one control unit for controlling and setting arbitrarily at least one of dew point, temperature and/or relative humidity of the gas flow. The control unit is provided between the exhaust duct and feed duct connected to at least one or each of the casings.

PREFERRED EMBODIMENTS OF THE INVENTION

Drying Cylinder and Inner Casing

Figure 1:
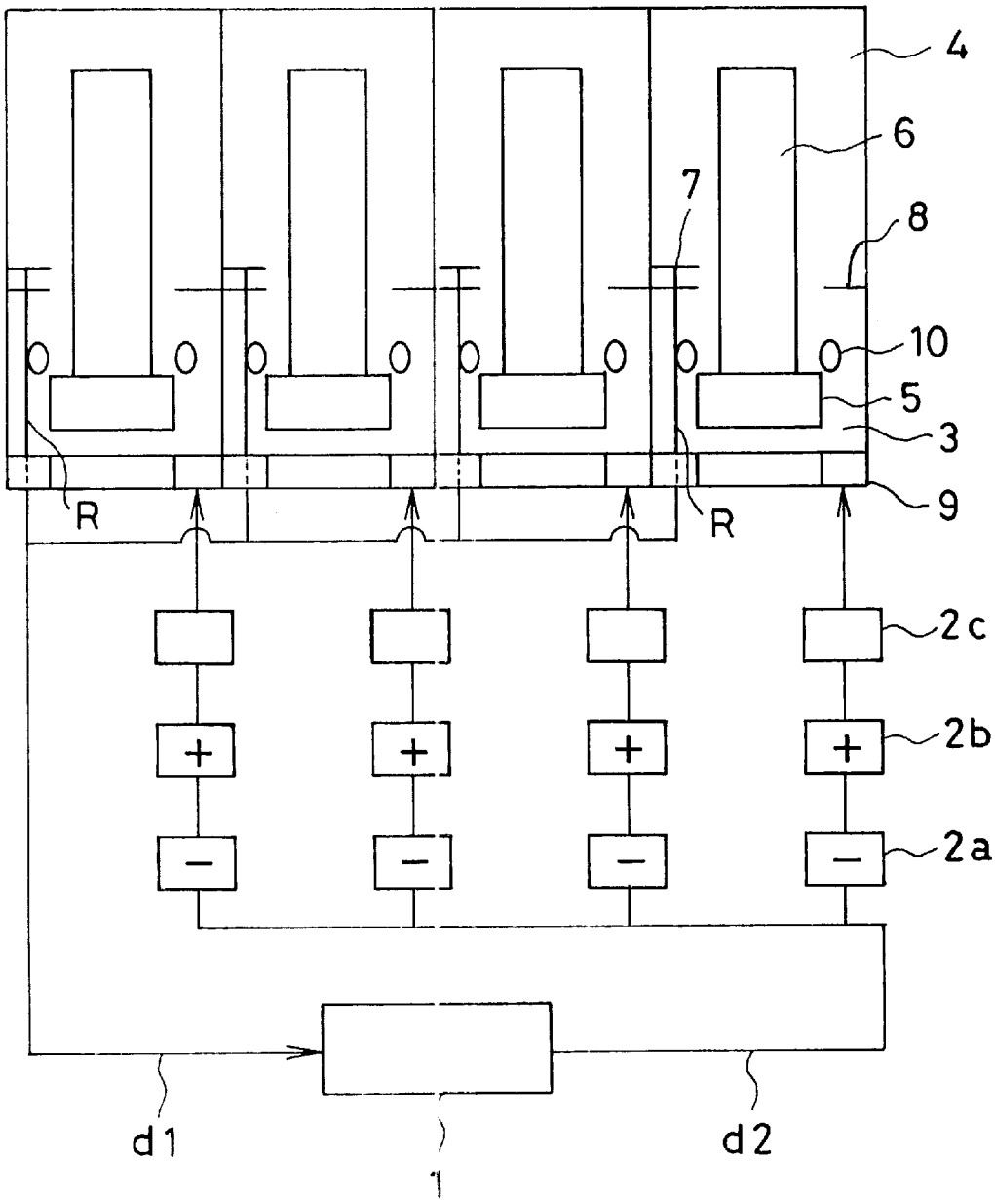
FIG. 1 is a schematic view showing a general composition of units contained in an exemplary drying device of the present invention.

In the present invention, as drying cylinder and inner casing, it is preferable to use so-called helical dryer which has an approximately cylindrical part through one end of which an opening is made for the entrance of a drying gas flow and on the outer periphery of which blowing openings (or vents) are provided for blowing the drying gas flow. Such a helical dryer is disclosed in, for example, JP-B-48-44151/1973.

In case of drying a long web-shaped drying object with the helical dryer, for instance, the long web-shaped drying object can be dried while running in such a way as to be wound helically around the helical dryer so that the surface of the drying object necessary to be dried faces the outer periphery of the helical dryer. The shape of the blowing openings may be, for example, hole or slit.

In case of drying the long web-shaped drying object as it is runing inside the plural number of casings successively, in a casing having the drying cylinder installed therein, or in an outer casing having an inner casing installed therein, there may be provided a slit (or a pair of slits) through wich the drying object passes, roller (or rollers) for guiding the run of the drying object, roller (or rollers) for changing the running direction of the drying object and the like. The drying gas flow may be any gas flow capable of drying the drying object which can be determined suitably depending on the kind of coating formed on the drying object. Examples of the drying gas flow include dry air, dry nitrogen and the like. By feeding the drying gas flow to the drying object, the drying object becomes dried. The gas flow has an elevated dew point after application to the drying object and drying the drying object.

Fan

As a fan, it is preferable to employ an axial-flow blower having an annular inlet for intaking a gas flow at the inlet side. The gas-intaking inlet may be a straight (or continuous) opening disposed on the outer periphery of the axial-flow blower or plural openings distributed on the outer periphery uniformly in the circumferential direction. In case of feeding the drying gas flow to the helical dryer by using the axial-flow blower, the helical dryer and the axial-flow blower are preferably arranged so that the longitudinal direction (the longitudinal direction of the approximately column-shaped inner space opened in the approximately cylindrical part) of the helical dryer corresponds to the gas-feed direction of the axial-flow blower.

In case of using the helical dryer together with the axial-flow blower, if air inspired by the axial-flow blower has dispersion in temperature and humidity along the outer periphery (circumferentially) of the axial-flow blower, corresponding dispersion of temperature and humidity is generated in gas flows blown out from the blowing openings of the helical dryer for blowing out a drying gas flow resulting from insufficiently admixing the drying gas flow. For this countermeasure, the following means may be provided.

There may be provided a uniformizer of a directly circulated gas flow for uniformizing the amount of the directly circulated gas flow flowing into the axial-flow blower along the outer periphery of the axial-flow blower. Such uniformizer includes an annular flow-restricting plate (or buffle) for restricting a return air flow which will be mentioned in a later paragraph of "EXAMPLE".

Further, there may be provided a uniformizer of a gas flow having a depressed dew point for uniformizing the amount of the gas flow having a depressed dew point flowing into the axial-flow blower along the outer periphery of the axial-flow blower. A uniformizer of this kind includes an annular blowing chamber having an annular blowing vent which will be mentioned in the paragraph of "EXAMPLE".

Moreover, there may be provided a moistening unit for uniformizing the humidity of a directly circulated gas flow along the outer periphery (circumferentially) of the axial-flow blower. A means of this kind includes an annular moistening nozzle which will be mentioned in the paragraph of "EXAMPLE".

Still more, there may be provided a uniformizer of a gas flow in temperature and humidity for uniformizing the temperature and humidity of a gas flow flowing into the axial-flow blower along the outer periphery of the axial-flow blower. A means of this kind includes a partition plate (buffle) which will be mentioned in the paragraph of "EXAMPLE".

EXAMPLE

Examples of the present invention will be explained as follows in reference to the accompanying drawings. FIG. 1 is a schematic view showing a general structure of units contained in an exemplary drying device of the present invention.

Example 1

The following explanation concerns the outline of a drying device of Example 1 shown in FIG. 1. A dehumidifying facility 1 employed communicates with a duct d1 which further communicates with a drying room including a helical dryer 6 therein, and dehumidifies an air flow flowing therein out of a drying room to produce a dehumidified air flow. Then, the dehumidified air flow runs out of the dehumidifying facility 1 into a duct d2. The duct d2 has four branches. First branch connects through a duct to an air cooler 2*a,* an air heater 2*b* and a humidifier 2*c* successively in this order, and communicates with an annular blowing chamber 9.

Accordingly, the dehumidified air flow branched at a junction and flowing into the first branch is cooled in the air cooler 2*a,* heated in the air heater 2*b,* and humidified in the humidifier 2*c* before flowing into the annular blowing chamber 9. The air flow after flowing into the annular blowing chamber 9 is humidified, but consists of an air flow having depressed dew point which is lower than that of the air flow flowing out of the drying room into the dehumidifying facility 1. The communicating structure between each of the second to forth branches and the annular blowing chamber is similar to that aforementioned. The process steps of the air flow having a depressed dew point after flowing into the annular blowing chamber 9 will be explained below.

On the other hand, a part of a gas flow used (or consumed) for drying a drying object in the drying room and consequently having an elevated dew point flows out of a return vent 7 for returning to the dehumidifying facility via a return duct R. Four return ducts, each communicating with different one of the four drying rooms shown in FIG. 1, merge to form single duct d1 which communicates with the dehumidifying facility. The gas flow used for drying a drying object in each of the drying rooms flows into the dehumidifying facility 1 and becomes dehumidified there to produce a dehumidified air flow which runs out of the duct d2. Then, the above procedure is repeated.

This drying device can set the temperature and humidity of dehumidified air flows flowing into the helical dryers respectively, so that the temperature and the humidity of respective drying gas flows exhausted by different helical dryers can be set at a desired value or values voluntarily. In case of drying a long web-shaped drying object with this drying device, in order to let the drying object pass through each of the drying rooms, a slit-shaped passage can be made through the wall comparting adjacent drying rooms, and roller(s) for assisting running, roller(s) for changing the running direction, and the like may be provided in each of the drying rooms.

Figure 2:
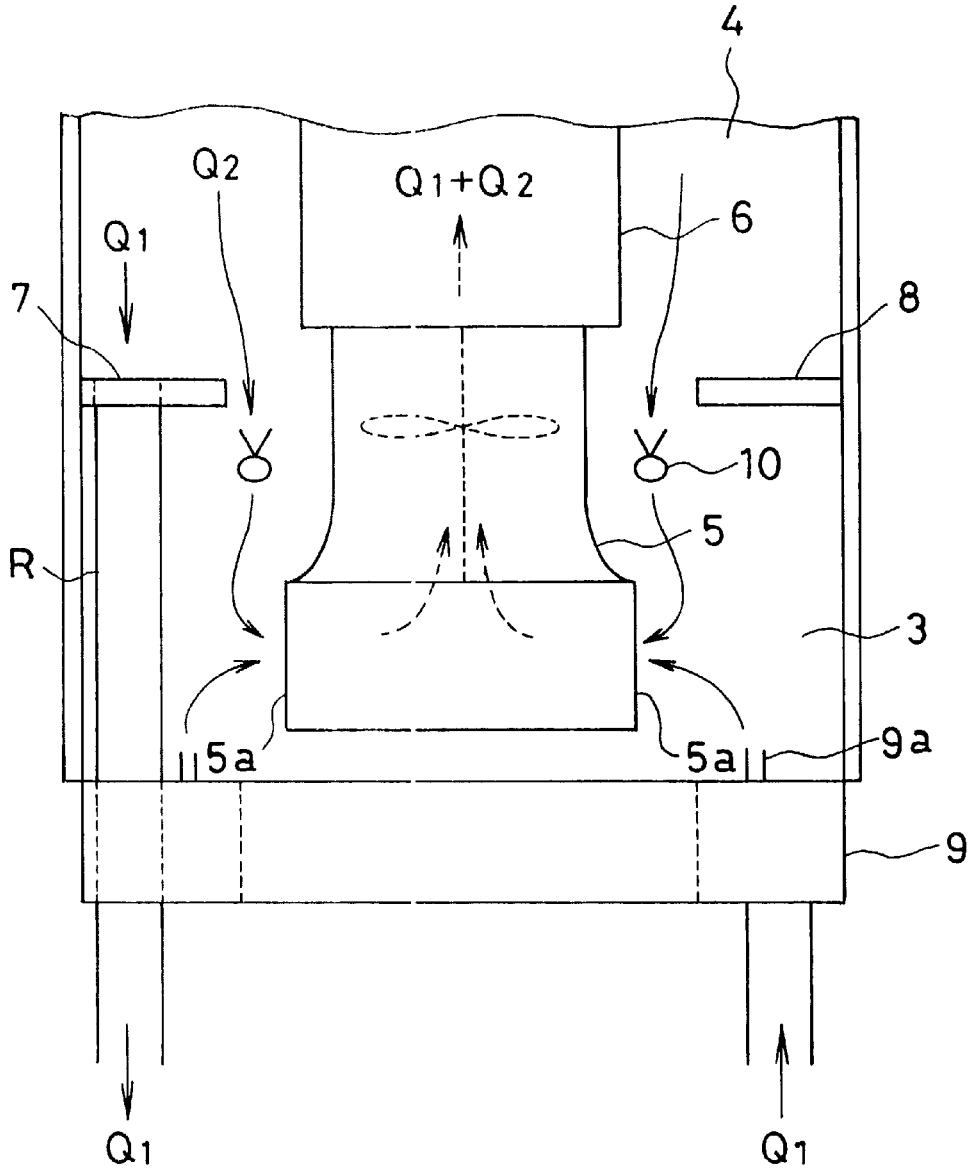
FIG. 2 is a sectional view taken in the longitudinal direction of a helical dryer showing blower-installing room, drying room and these neighborhood in the exemplary drying device of the present invention.

Then, the process of the air flow having a depressed dew point after flowing into the annular blowing chamber 9 will be explained below in reference to FIG. 2. FIG. 2 is a sectional view taken in the longitudinal direction of the helical dryer 6 showing blower-installing room 3, drying room and the neighborhood thereof in the exemplary drying device of the present invention.

The dehumidified air flow (fresh flow) generated by dehumidification in the dehumidifying facility 1 flows into the annular blowing chamber 9 after adjusting its temperature and humidity to a predetermined value. The adjusted air flow having a depressed dew point is fed into the blower-installing room 3 from the annular blowing vent 9*a*. In the inner space of the blower installing room 3, an axial-flow blower is installed.

On the other hand, a part of an air flow (return air flow) which has been blown out of blowing openings of the helical dryer 6 in the drying room 4, flows out of the return vent 7 for returning to the dehumidifying facility through the return duct R into the dehumidifying facility 1, and becomes dehumidified. The return vent 7 for returning to the dehumidifying facility is provided on the inner wall side of the drying room 4. The dehumidified air flow generated by dehumidification in the dehumidifying facility 1 is converted into an air flow having a depressed dew point as mentioned above, and is fed through the annular blowing (inlet) chamber 9 into the blower-installing room 3.

A part of an air flow, which has been blown out of the gas blowing openings provided on the helical dryer 6 placed in the drying room, but which does not flow into the return vent 7 for returning to the dehumidifying facility, flows into the blower-installing room 3 through an annular space opened between an annular flow-restricting plate (buffle) 8 for restricting a return air flow provided inside the cylindrical drying room 4 along the inner periphery thereof and the approximately cylindrical air-flow blower 5. During this time, the inflowing air flow is humidified, inside the blower-installing room at a position downstream than the annular space, with an annular moistening nozzle 10 placed apart from the outer periphery of the approximately cylindrical axial-flow blower 5 around the axial-flow blower along the outer periphery of the blower. The air flow humidified with the annular moistening nozzle 10 is then inspired via intake vents (inlets) 5*a* opened on the outer periphery of the approximately cylindrical axial-flow blower 5 into the axial-flow blower 6.

In other words, the axial-flow blower inspires the air flow having a depressed dew point, which has been fed out of the annular blowing vent 9*a* of the annular blowing chamber 9 into the blower-installing room 3, and the humidified air flow generated through the steps of feeding on a drying object, flowing out of the drying room 4 into the blower-installing room 3, and then moistening, via the intake vent(s) opened on the outer periphery of the axial-flow blower, and then feeds the mixture of the air flow having the depressed dew point and the humidified air flow out of a feed vent for feeding a gas flow, which is connected to an entrance of the helical dryer 6 for getting a drying gas flow therein, into the helical dryer 6. The humidified air flow means a directly circulated gas flow generated by circulating a gas flow fed on a drying object directly into a gas flow feeder without passing through the dehumidifying facility 1.

The helical dryer 6 is cylindrical, and has an approximately column-shaped inner space communicating from an open end used for the entrance of a drying gas flow along the longitudinal direction, and blowing openings for flowing out a gas flow on (and out of) its outer periphery. The mixture of the air flow having a depressed dew point and the humidified air flow is used as a drying gas flow through the blowing openings opened on the out periphery of the helical dryer 6, and dries a drying object. The air flow used for drying the drying object partially flows out of the return vent 7 for returning to the dehumidifying facility 1 as aforementioned. The other part (remainder) flows into the blower-installing room 3, and directly circulated into a gas flow feeder to be used as a directly circulated gas flow.

In the axial-flow blower 5 of an approximately cylindrical form, in order to restrain the in uniformity of the temperature and the humidity of the inspired air distributed at the outer peripheral area, the annular flow-restricting plate 8 for restricting a return air flow, the annular blowing chamber 9 equipped with the annular blowing vents 9*a,* and the annular moistening nozzle 10 are used. Details of these will be explained as follows.

The annular flow-restricting plate 8 for restricting a return air flow uniformizes the flow rate Q2 of a return air flow which returns from the drying room to the blower-installing room over the outer peripheral area of the axial-flow blower in order to uniformize the temperature and the humidity of an air flow inspired into the axial-flow blower after being admixed with the air flow having a depressed dew point at the outer peripheral area of the axial-flow blower.

The annular blowing chamber 9 equipped with the annular blowing vent 9*a* uniformizes the flow rate of the air flow having the depressed dew point flowing into the blower-installing room at the outer peripheral area of the axial-flow blower in order to uniformize the temperature and the humidity of the air flow inspired into the axial-flow blower after being admixed with the return air flow flown into the blower-installing room along the outer periphery of the axial-flow blower. The flow rate of the air flow having the depressed dew point which enters into the blower-installing room is preferably the same with the flow rate $Q_1$ of the air flow flowing out of the drying room into the return vent 7 for returning to the dehumidifying facility.

The annular moistening nozzle is used for humidifying the return air flow flowing out of the drying room into the blower-installing room to control the humidity of a drying air flow blown out by the helical dryer 6. This nozzle is annular lest the deviation (dispersion) in the humidity occurs in the return air flow at the outer peripheral area of the axial-flow blower, and makes it possible to humidify the return air flow uniformly along the outer periphery of the axial-flow blower by placing near the opening of the annular flow-restricting plate 8 for restricting a return air flow as shown in FIG. 2.

Example 2

Figure 3:
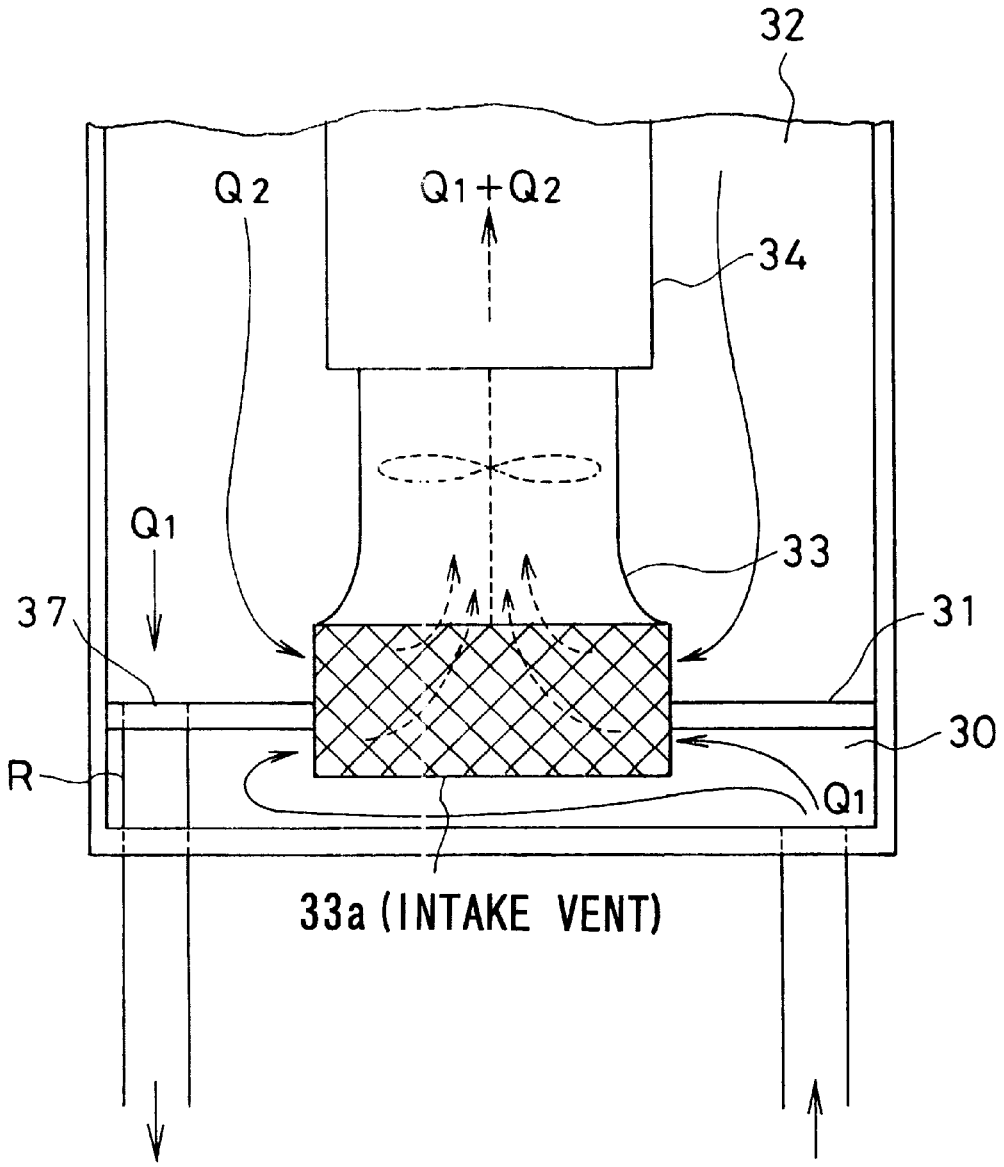
FIG. 3 is a sectional view taken in the longitudinal direction of a helical dryer showing flowing room of an air flow having depressed dew point, drying room and these neighborhood in another exemplary drying device of the present invention.

The drying room and the blower-installing room in the drying device of the above Example 1 may have an inner structure as shown in FIG. 3. FIG. 3 is a sectional view taken in the longitudinal direction of the helical dryer showing flowing room of an air flow having a depressed dew point, drying room and neighborhood thereof in another exemplary drying device of the present invention.

The air flow having a depressed dew point flows through a duct into the influent room of the air flow having a depressed dew point. The influent room of the air flow having a depressed dew point is formed by partitioning a cylindrical room, which includes therein an approximately cylindrical axial-flow blower 33 which connects to a helical dryer 34 at the open end of the dryer and enables to feed a drying air flow into the helical dryer thereby. A partition board 31 extends in the radial direction thereof, thereby partitioning the cylindrical room axially in two parts.

Explaining more in detail, the partition board 31 is arranged in the direction of intersecting the inner space of the cylindrical room, and divides the inner space into the influent room 30 of the air flow having a depressed dew point and the drying room 32. The approximately cylindrical axial-flow blower 33 is arranged in such manner as to have its blowing direction almost perpendicularly to the circular surface of the partition board. The drying room 32 is positioned on the side where the helical dryer 34 is placed. Along the blowing direction of the approximately cylindrical axial-flow blower, the length of the outer periphery of the axial-flow blower on which an intake vent 33*a* is formed is longer than the thickness of the partition board. Consequently, the intake vent 33*a* is opened on both sides intersected by the partition board (i.e., on both the sides of the flowing room of the air flow having the depressed dew point and the drying room). Therefore, gas contained in both of the flowing room of the air flow having the depressed dew point and the drying room can be inspired.

Accordingly, the air flow having the depressed dew point after flowing into the flowing room of the air flow having the depressed dew point is then intaken into the axial-flow blower. On the other hand, a part of an air flow (return air flow) blown out of blowing openings provided on the outer periphery of the helical dryer flows out of a return vent for returning to a dehumidifying facility through a return duct and others if necessary into the dehumidifying facility. The other part of the return air flow is intaken into the intake vent (or vents) 33*a* provided on the outer periphery of the axial-flow blower 33, fed into the helical dryer 34 after being admixed with the air flow having the depressed dew point, and blown out of the blowing openings provided on the outer periphery of the helical dryer on a drying object. Consequently, the drying object becomes dried.

The flow rate of the air flow having the depressed dew point which enters into the flowing room of the air flow having the depressed dew point is preferably the same with the flow rate $Q_1$ of the air flow flowing out of the drying room into the return vent 37 for returning to the dehumidifying facility. The flow rate of the admixed air flow fed into the helical dryer 34 is preferably adjusted to the sum of the flow rate $Q_1$ of the air flow having the depressed dew point and the flow rate $Q_2$ of an air flow which is the air flow (return air flow) blown out of the blowing openings provided on the outer periphery of the helical dryer but not flown out of the return vent 37 for returning to the duhumidifying facility.

In case of using the axial-flow blower, if there is deviation (or dispersion) in the temperature and the humidity of air to be intakent in the outer peripheral area of the axial-flow blower, deviation (or dispersion) also arises in the temperature and humidity at the blowing openings of the helical dryer on account that sufficient admixing cannot be made. If the configuration shown in FIG. 3 has no partition board 31, the return air flow and the air flow having the depressed dew point starts to be admixed before being intaken into the axial-flow blower. Consequently, it is difficult to uniformize the admixing ratio on the outer peripheral area of the axial-flow blower. By setting the partition board 31, the return air flow and the air flow having depressed dew point are admixed after being absorbed into the axial-flow blower. Accordingly, it becomes possible to uniformize the temperature and the humidity of the air flow aspirated into the axial-flow blower along the periphery.

Example 3

In the drying device of the above described Example 1 shown in FIG. 1, all of drying air flows fed by four drying devices are changed into the mixture of the directly circulated air flow and the air flow having the depressed dew point. However, drying air flow(s) fed by limited (as a limited number of) helical drying device(s) can be made selectively to change into the mixture of the directly circulated air flow and the air flow having the depressed dew point. Namely, depending on the predetermined condition of drying temperature and humidity, the above admixed air flow can be fed on a drying object by the limited, specified helical dryer(s) installed in the limited (specified) drying room(s) in which drying can be carried out with a large degree of freedom.

Figure 4:
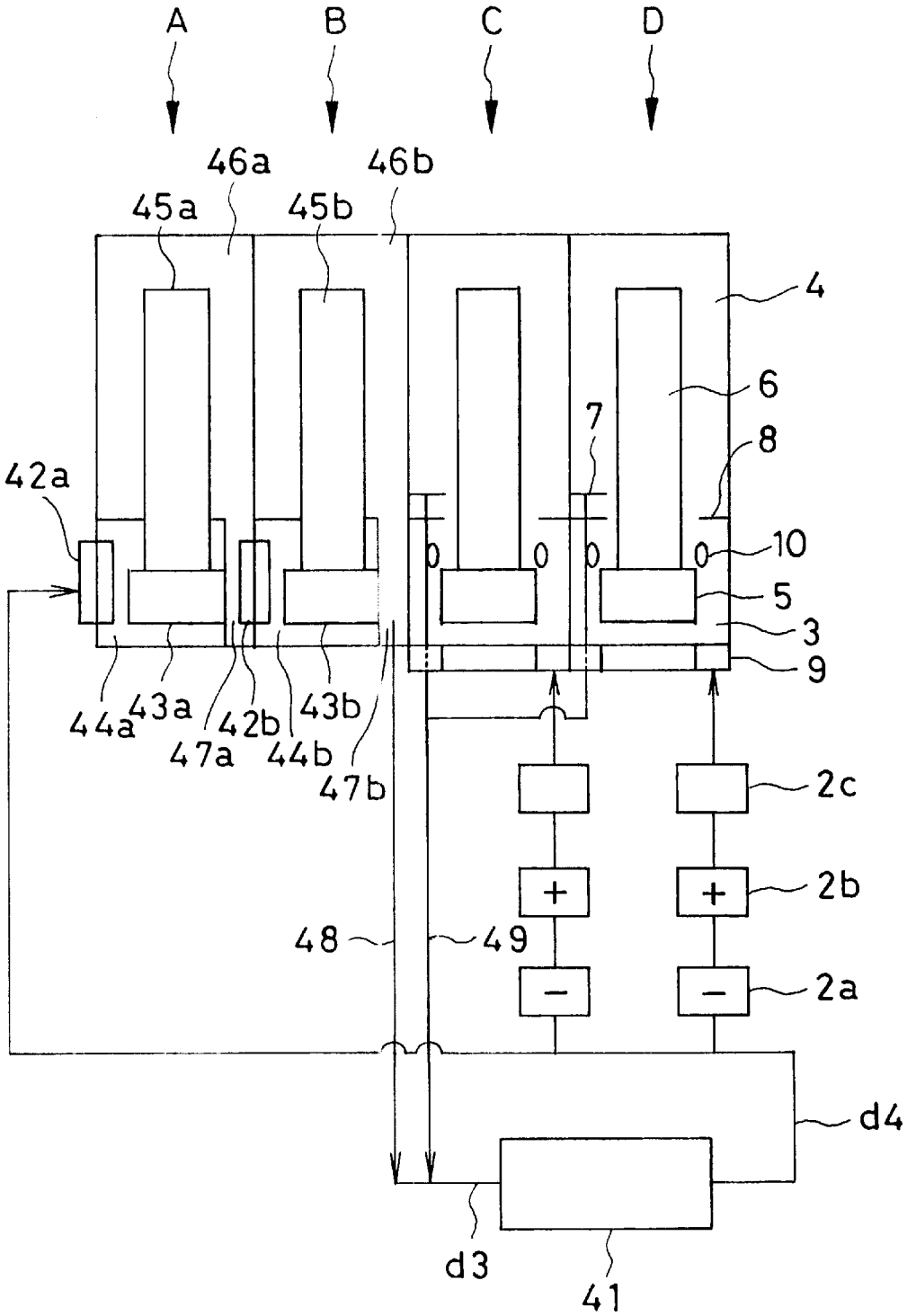
FIG. 4 is a schematic view showing a general composition of units contained in an exemplary drying device of the present invention.
Figure 5:
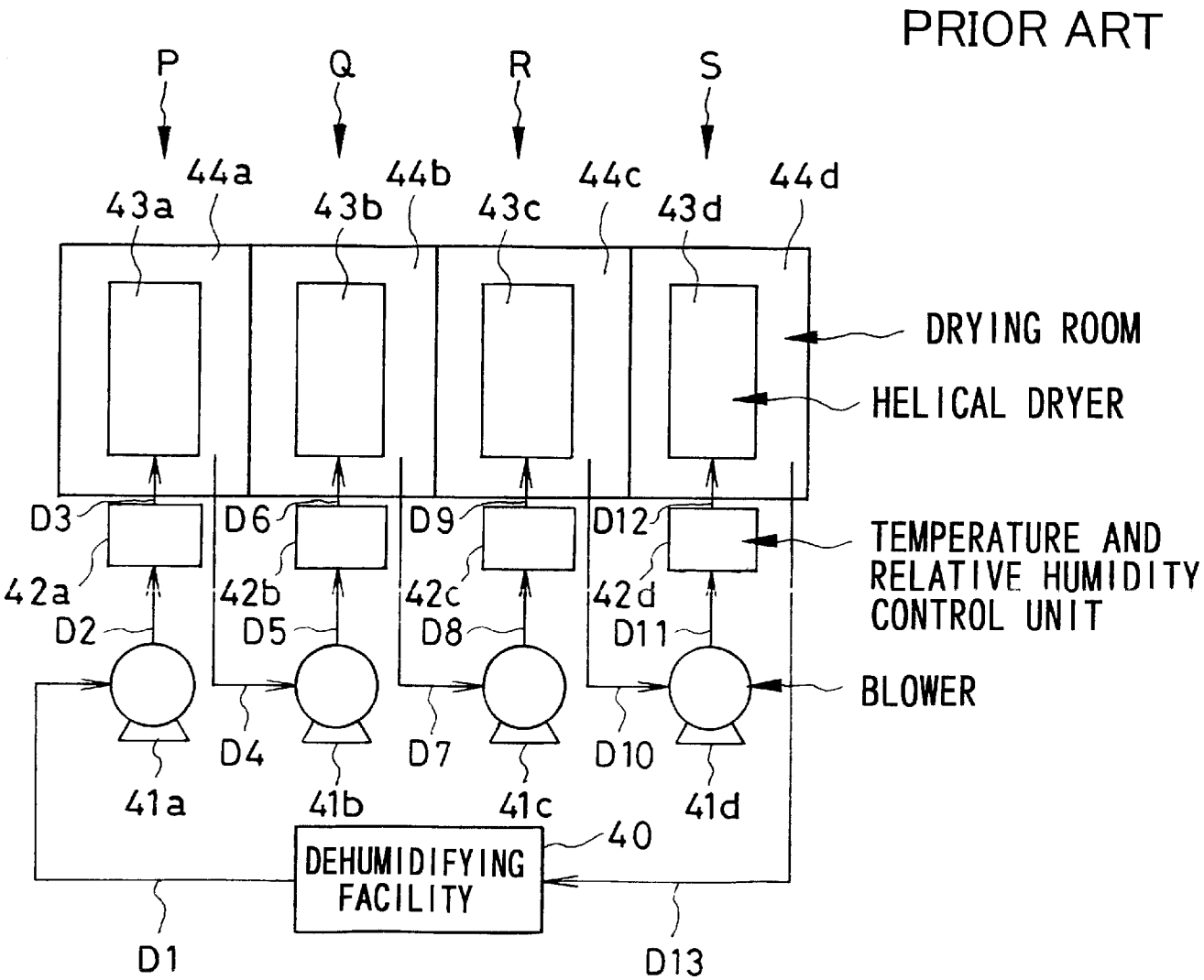
FIG. 5 is a schematic view showing a general composition of units contained in a conventional drying device.

An example of this case will be explained below in reference to FIG. 4. FIG. 4 is a schematic view showing a general disposition (or arrangement) of units contained in an exemplary drying device of the present invention. This drying device includes drying zones A, B, C and D. The drying zone D is composed of the same units as those explained in the above Example 1. Main components are marked by the same reference symbols, respectively. The drying zone C has the same constitution with that of the drying zone D.

An outline of a flowing process with regard to a drying air flow run out of a dehumidifying facility 41 installed in this drying device is as follows. A dehumidified air flow generated by dehumidification in the dehumidifying facility 41 flows into a duct d4. The duct d4 has two branches. First branch communicates with the drying zone D, and second branch communicates with the drying zone C. The dehumidified air flow is divided into two flows at a junction of each branch. Thereafter, the same procedure of Example 1 is repeated. Out of the drying zones C and D, as explained in the above Example 1, a part of an air flow fed on a drying object is exhausted into different ducts respectively, and these exhausted air flows join at (the beginning part of) a duct 49.

On the other hand, a dehumidified air flow, separating at a junction of the second branch but not flowing into the drying zone C, flows through the drying zones A and B and finally into a duct 48. Into the duct 48, an air flow after being blown in the drying zone B for drying a drying object enters. The air flows passing through the ducts 48 and 49 join (merge) into a duct d3, then flow through the duct d3 into the dehumidifying facility 41, and become dehumidified there. The dehumidified air flow outflows into the duct d4. Thereafter, the same procedure as stated above is repeated.

A process performed in the drying zones A and B is as follows. The dehumidified air flow, separated at a junction of the second branch but not flowing into the drying zone C, then flows into a blower-installing room 44*a* after adjusting its temperature and humidity with a temperature and relative humidity control unit 42*a* provided in an intake vent of the blower-installing room 44*a*. In the blower-installing room 44*a*, an axial-flow blower 43*a* is installed. A feed vent of this axial-flow blower 43*a* for feeding a gas flow is directly connected to the entrance of a gas flow provided at the end of a helical dryer in the form of a cylinder installed in a drying room 46*a* for feeding a drying gas flow into the helical dryer 45*a*. The drying gas flow stored in the blower-installing room 44*a* is fed into the approximately column-shaped inner space of the helical dryer 45*a* in the form of a cylinder with the axial-flow blower 43*a*. On the outer periphery of the cylindrical helical dryer 45*a*, blowing openings of holes or slits are provided, so that the drying gas flow fed into the inner space of the helical dryer 45*a* is fed through the blowing openings on a drying object. Thereby, the drying object becomes dried.

A moistened gas flow, which is the result of drying the drying object, enters in a return-blow-flowing passage 47*a* provided adjacent to the blower-installing room in which the blower is installed, and flows through the return-blow-flowing passage 47*a* into a blower-installing room 44*b* after adjusting temperature and humidity with a temperature and relative humidity control unit 42*b* provided in a through-hole opened through a partition wall between the drying room 46*a* and the blower-installing room 44*b*.

The drying device of Example 3 shown in FIG. 4 further includes an axial-flow blower 43*b* in the inner space thereof, and the drying zone B having the blower-installing room equipped with a temperature and relative humidity control unit 42*b* and drying room 46*b* having a helical dryer 45*b* installed in the inner space thereof.

The same components as the drying zone A having the same functions, respectively, are employed in the drying zone B. Also a return-blow-flowing passage 47*b* is the same with the return-blow-flowing passage 47*a*.

A gas flow after flowing through the return-blow-flowing passage 47*b* out of the drying room 46*b* runs into the duct 48. A process of a gas flow after flowing into the duct 48 has been already explained.

In all of the aforementioned examples, greater part of an air flow fed on a drying object circulates without going outside a drying room or a blower-installing room. Accordingly, minimum air flow necessary for adjusting temperature and humidity is limitedly returned to a dehumidifying facility, and then to a gas flow feeder after passing through air cooler, air heater and/or humidifier and changing into a gas flow having a depressed dew point thereby.

For this reason, the size of the duct through which the gas flow having a depressed dew point passes may be miniaturized. Air cooler, air heater and/or humidifier all of which are used for adjusting the temperature and the humidity of the gas flow having a depressed dew point may also be miniaturized. Consequently, it is possible to make the total size of a device including these components (or units) compact. Further, the amount of air passing through the duct may be comparatively small so that the energy consumption of a blower required for making the air pass through the duct(s) can be diminished. In the drying zones A and B included in the drying device of the above Example 3, it can be realized to remove completely some ducts, in especial, a duct provided between adjacent drying rooms into which a gas flow runs sequentially.

Further, in all of the drying devices used in the above examples, blowers each feeding a gas flow into a helical dryer may be arranged in series to the helical dryers respectively. This makes it easy to perform works not only attaching meters and electric devices to the machine but also for securing the blowers respectively. Moreover, the device as a whole may be made to be compact so that it is possible to reduce the space of a building in which the device is installed and costs including the building cost.

The meritorious effect of the present invention are summarized as follows.

A drying device of the present invention includes a casing including at least a cylindrical drying cylinder for exhausting a drying gas flow fed therein out of gas-blowing openings disposed on its outer periphery to feed on a drying object, and a fan connected to the entrance side of the drying cylinder. The fan intakes a gas flow blown out of the drying cylinder into the casing inside the same casing and feeding into the drying cylinder again to circulate the gas flow. A part of a gas flow intaken by the fan consists of a gas flow having a depressed dew point which results from splitting a gas flow blown out of the drying cylinder and depressing the dew point of the split gas flow outside the casing.

Further, according to the present invention, there is provided a drying device which includes an outer casing including at least an inner casing for blowing a drying gas flow fed therein out of openings distributed on its outer periphery to feed on a drying object, and a fan connected to the entrance side of the inner casing for inspiring a gas flow blown out of the inner casing into the outer casing and feeding into the inner casing again to circulate the gas flow, and a dew point depressing unit which splits a gas flow blown out of the inner casing into the outer casing, depresses the dew point of the split gas flow and feeds the resultant gas flow having the depressed dew point into the fan.

Accordingly, in these drying devices of the present invention, the temperature and the humidity of gas flows each fed into one of helical dryers (and accordingly, the temperature and the humidity of exhausting gas flows) can be controlled in wide ranges respectively. Further, a gas flow is used in such manner as to circulate inside the casing so that it is not necessary to make all of the gas flow pass through a duct or ducts. Accordingly, energy can be saved more than the case of passing all of the gas flow through the duct.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A drying device comprising a casing having therein at least a cylindrical drying cylinder blowing a drying gas flow fed therein out of a gas blowing area disposed on its outer periphery to feed the gas on a drying object, and a fan connected to an entrance side of said drying cylinder, said fan inspiring a gas flow blown out of said drying cylinder into said casing inside the casing and feeding into said drying cylinder again to circulate said gas flow, a part of a gas flow inspired by said fan having a depressed dew point which results from splitting a gas flow blown out of said drying cylinder and depressing the dew point of the split gas flow outside said casing.

2. A drying device as defined in claim 1, wherein said casing is provided in a plurality of number, each of said casings being connected to an exhaust duct and a feed duct, said exhaust duct exhausting a part of a gas flow blown out of said drying cylinder into said casing and fed on said drying object, said exhaust duct communicating with a dew point depression unit, and said feed duct feeding a gas flow having a depressed dew point obtained by depressing the dew point of a gas flow exhausted out of said exhaust duct using said dew point depression unit.

3. The drying device as defined in claim 1, wherein said fan is an axial-flow blower having an annular inlet for intaking a gas flow at an inlet side thereof.

4. The drying device as defined in claim 3, further comprises an influent control unit of a directly circulated gas flow, which is a gas flow flowing into said fan other than said flow gas flow having the depressed dew point, said influent control unit controlling the amount of said directly circulated gas flow at an outer peripheral area of said fan.

5. The drying device as defined in claim 3, which further comprises an influent control unit of a gas flow having a depressed dew point, said influent control unit controlling the amount of said gas flow having a depressed dew point flowing into said fan at an outer peripheral area of said fan.

6. A drying device comprising an outer casing having therein at least an inner casing for blowing a drying gas flow fed therein out of openings disposed on its outer periphery to feed on a drying object, a fan connected to an entrance side of said inner casing, said fan inspiring a gas flow blown out of said inner casing into said outer casing and feeding into said inner casing again to circulate said gas flow, and a dew point depressing unit which splits a gas flow blown out of said inner casing into said outer casing to provide a split gas flow, depresses the dew point of the split gas flow and feeds the resultant gas flow having the depressed dew point into said fan.

7. The drying device as defined in claim 6, wherein said outer casing is present in a plurality of number, each of said outer casings being connected to an exhaust duct and a feed duct, respectively, said exhaust duct partially exhausting a gas flow blown out of said inner casing into said outer casing and fed on said drying object, and communicating with a dew point depression unit, said feed duct feeding a gas flow having depressed dew point obtained by depressing the dew point of the gas flow exhausted out of said exhaust duct by the application of said dew point depression unit.

8. The drying device as defined in claim 6, wherein said fan is an axial-flow blower having an annular inlet for intaking a gas flow at an inlet side thereof.

9. The drying device as defined in claim 8, which further comprises: in an opening-less area located between a nearest opening to said axial-flow blower among all openings disposed on the outer periphery of said inner casing and the inlet of said axial-flow blower, a flow-restricting plate, which partitions the inside of said outer casing into two parts leaving an annular space opened around the outer periphery of said inner casing and said axial-flow blower; and a return vent which opens through said flow-restricting plate or opens on the opening side relative to said flow-restricting plate, on the outer periphery of said inner casing, and communicates with said dew point depression unit.

10. The drying device as defined in claim 6, wherein said axial-flow blower is in the form of a cylinder and comprises an annular inlet for intaking a gas flow on the outer peripheral area of the blower, said drying device further comprises: a partition board dividing said inlet into two parts axially of said axial-flow blower and also the inside of said outer casing into two parts to provide, inside said outer casing, an influent room of a gas flow having a depressed dew point, said influent room communicating with one part of the divided inlet and having an inlet of a gas flow having a depressed dew point; and a return inlet which opens through said partition board or opens on a side of said openings of the outer periphery of said inner casing relative to said partition board, said return vent communicating with said dew point depression unit.

11. The drying device as claimed of claim 6, which further comprises:

a first outer casing comprising therein at least a first inner casing for blowing a drying gas flow fed therein out of openings disposed on its outer periphery to feed the gas on a drying object; and a second outer casing comprising at least a second inner casing for blowing a drying gas flow fed therein out of openings disposed on its outer periphery to feed the gas on a drying object, a fan connected to an inlet side of said second inner casing, and an influent room of a gas flow for letting the gas flow inspired by said fan flow therein, wherein the gas flow fed on a drying object in said first outer casing subsequently flows into the influent room disposed in said second outer casing, and an exit of the gas flow provided in said first outer casing serving as an inlet of the gas flow provided in said influent room disposed in said second outer casing.

12. The drying device as claimed in claim 2, which further comprises at least one control unit for controlling and setting arbitrarily at least one condition selected from the group consisting of dew point, temperature and relative humidity of the gas flow, said control unit being provided between said exhaust duct and said feed duct connected to at least one of said casings.

13. The drying device as claimed in claim 7, which further comprises at least one control unit for controlling and setting arbitrarily at least one condition selected from the group consisting of dew point, temperature and relative humidity of the gas flow, said control unit being provided between said exhaust duct and said feed duct connected to at least one of said casings.

* * * * *